US008448632B2

(12) United States Patent
Ma

(10) Patent No.: US 8,448,632 B2
(45) Date of Patent: May 28, 2013

(54) TOY GUN COMPRESSED AIR FIRING SHELL

(75) Inventor: Chor-Ming Ma, Kowloon (CN)

(73) Assignee: Buzz Bee Toys (H.K.) Co., Limited, Kowloon, Hong Kong (CN)

( * ) Notice: Subject to any disclaimer, the term of this patent is extended or adjusted under 35 U.S.C. 154(b) by 102 days.

(21) Appl. No.: 13/178,132

(22) Filed: Jul. 7, 2011

(65) Prior Publication Data

US 2012/0304975 A1 Dec. 6, 2012

(30) Foreign Application Priority Data

May 30, 2011 (HK) ..... 11105337.8

(51) Int. Cl.
*F41B 11/00* (2006.01)

(52) U.S. Cl.
USPC ..... 124/73

(58) Field of Classification Search
USPC ..... 124/56, 57, 73; 42/54; 446/473
See application file for complete search history.

(56) References Cited

U.S. PATENT DOCUMENTS

| | | | | |
|---|---|---|---|---|
| 279,539 | A * | 6/1883 | Chamberlain | 102/375 |
| 2,327,653 | A * | 8/1943 | Lisle | 124/57 |
| 4,601,278 | A * | 7/1986 | Kim | 124/57 |
| 4,697,523 | A * | 10/1987 | Saxby | 102/440 |
| 5,645,038 | A | 7/1997 | Luk | |
| 5,700,972 | A * | 12/1997 | Saxby | 102/440 |
| 6,408,837 | B1 | 6/2002 | Johnson et al. | |
| 6,428,384 | B1 * | 8/2002 | Su | 446/473 |
| 6,619,278 | B1 * | 9/2003 | Lin | 124/57 |
| 7,549,416 | B2 * | 6/2009 | Lin | 124/65 |
| 2006/0027223 | A1 * | 2/2006 | Vasel et al. | 124/57 |
| 2007/0283942 | A1 | 12/2007 | Tai et al. | |
| 2009/0007896 | A1 | 1/2009 | Chung-Kuan | |
| 2009/0050127 | A1 * | 2/2009 | Wygant | 124/56 |
| 2009/0151710 | A1 * | 6/2009 | Zimmerman | 124/48 |
| 2010/0199960 | A1 * | 8/2010 | Chong | 124/57 |

FOREIGN PATENT DOCUMENTS

| | | |
|---|---|---|
| CN | 2260307 | 8/1997 |
| JP | 2040498 | 2/1990 |
| JP | 6123594 | 5/1994 |

OTHER PUBLICATIONS

Hong Kong Search Report.

* cited by examiner

*Primary Examiner* — Bret Hayes
(74) *Attorney, Agent, or Firm* — Alix, Yale & Ristas, LLP

(57) ABSTRACT

A compressed air firing shell for a toy gun includes a firing chamber for receiving a soft projectile and a pressure chamber to store a high-pressure charge of air. A release port delimits the pressure chamber from the firing chamber. A piston within the pressure chamber seals the release port and unseals the release port upon triggered activation of the activation member to allow the charge to pass from the pressure chamber to the firing chamber to effect firing of the soft projectile.

27 Claims, 8 Drawing Sheets

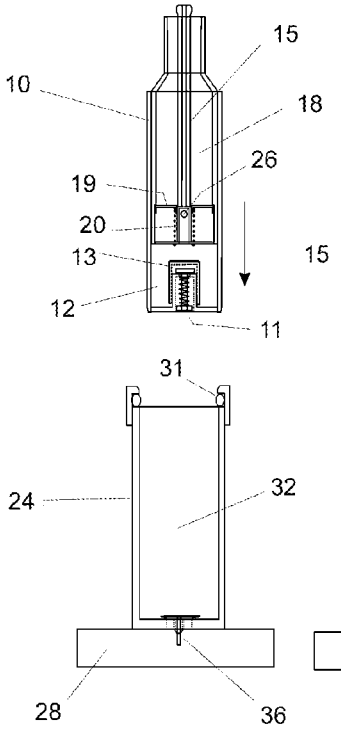
Fig. 6
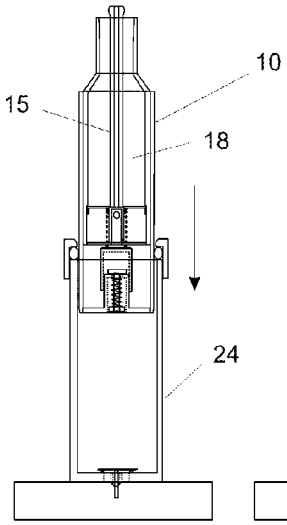
Fig. 7
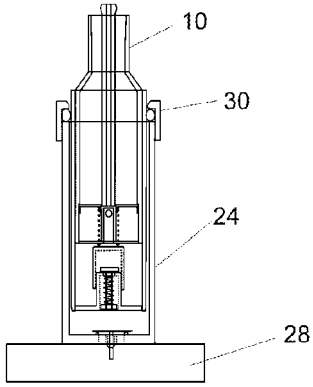
Fig. 8
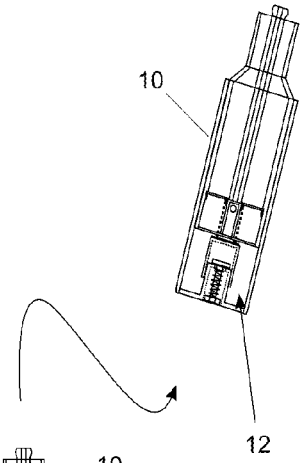
Fig. 9
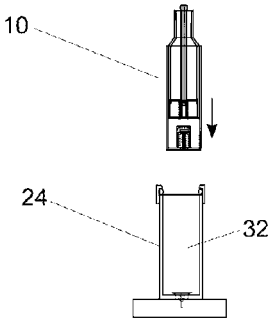
Fig. 10
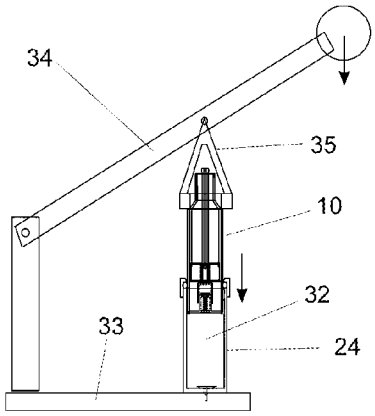
Fig. 11
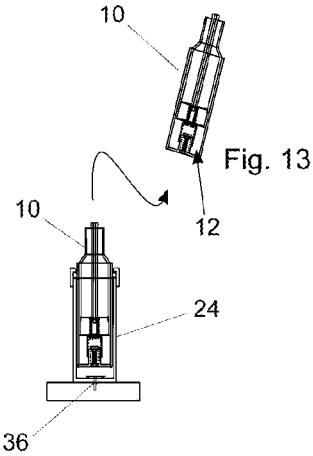
Fig. 12
Fig. 13

TOY GUN COMPRESSED AIR FIRING SHELL

BACKGROUND OF THE INVENTION

The present invention relates to toy guns capable of shooting soft projectiles upon the release of stored compressed air. The invention more particularly, although not exclusively, relates to firing shells which can store a charge of compressed air for use, or integrated with such toy guns.

Toy guns capable of firing soft projectiles upon release of compressed air are known. These comprise pump-action or other mechanisms for forcing a jet of air against a projectile to cause it to be fired from the toy gun. The various known firing mechanisms are complex and costly to manufacture and can be unreliable in use. Furthermore, rapid-firing toy machine guns cannot generally exploit compressed air firing due to complexities associated with recharging a store of compressed air.

A compressed air firing shell for a toy gun overcomes or substantially ameliorates at least one of the above disadvantages and/or more generally provides an improved means of storing and releasing a charge of compressed air to fire soft projectiles from toy guns.

SUMMARY

There is disclosed herein a compressed air firing shell for a toy gun, comprising:

a firing chamber for receiving a soft projectile;

a pressure chamber adapted to store a high-pressure charge of air therein;

a release port from the pressure chamber to the firing chamber;

an activation member; and a piston within the pressure chamber and sealing the release port and adapted upon triggered activation of the activation member to unseal the release port thereby allowing the charge to pass from the pressure chamber to the firing chamber to effect firing of the soft projectile therefrom.

Preferably, the firing shell further comprises an inlet valve via which pressurised air can enter the pressure chamber to provide said charge of air.

Preferably, said inlet valve is incorporated into the activation member.

Preferably, the activation member comprises a pin biased by a spring into a sealed position, the pin adapted to move against the spring and away from the sealed position upon application of external air pressure thereto to enable charging of the pressure chamber.

Preferably, the activation member comprises a cylindrical housing within which the spring is located, the piston sliding upon the cylindrical housing.

Alternatively, the piston can slide upon an inner surface of the pressure chamber.

Preferably, the firing shell further comprises protection means for preventing the firing of items other than a soft projectile having an elongate cavity from the firing chamber.

Preferably, the firing shell further comprises an elongate firing tube extending into the firing chamber and through which air passes from the release port, the elongate tube adapted to fit within an elongate cavity of the soft projectile.

Preferably, the elongate firing tube comprises a bleeder opening nearby the release port, and protection means comprise a sliding disc surrounding the elongate firing tube and movable between a first use position whereat air exiting the bleeder opening enters the elongate cavity of the soft projectile causing it to be fired, and a second non-use position whereat air exiting the bleeder opening is trapped behind the sliding disc.

Preferably, the firing shell further comprises a light spring biasing the sliding disc into the second position, the sliding disc adapted to compress the light spring upon interaction with the soft projectile.

Alternatively, the protection means comprises vents in the firing chamber adapted to surround the soft projectile.

Alternatively, the protection means comprises a base cylinder adjacent to the release port and adapted to surround a portion of the soft projectile.

There is further disclosed herein a charging mechanism when used with the above-disclosed firing shell, the charging mechanism comprising a charging cylinder containing a volume of air, the charging cylinder comprising a seal for sealing the volume of air against the exterior of the firing shell, reduction of said volume upon interaction with the firing shell pressurising the volume to thereby open the inlet valve so that air from the volume enters the pressure chamber to charge the pressure chamber.

Preferably, the volume is adapted to at least partially receive the firing shell to cause said reduction in volume.

Preferably, the seal is adapted to allow air to flow into the volume upon extraction of the firing shell from the volume.

The charging mechanism can further comprise a check valve adapted to allow air to flow into the volume upon extraction of the firing shell from the volume.

The charging mechanism can further comprise a base upon which the charging cylinder is mounted, a lever mounted to the base and adapted to bear down upon the firing shell for insertion thereof into the volume.

Alternatively, the charging mechanism can comprise a charging piston adapted to slide into the charging cylinder to cause said volume reduction.

There is further disclosed herein a toy gun incorporating the above-disclosed firing shell.

Preferably, the toy gun comprises a trigger-activated firing pin adapted to strike the activation member to effect said triggered firing activation.

Preferably, the firing shell is formed integrally with the toy gun.

Alternatively, the toy gun is adapted to receive the firing shell in removable fashion.

There is further disclosed herein a toy gun adapted to receive, or having integrally formed therein a multitude of the above-disclosed firing shells.

The toy gun might comprise an integral charging cylinder from which pressurised air is charged into each firing shell.

The toy gun might further comprise an advancing mechanism for aligning each charging shell with the charging cylinder.

There is further disclosed herein a toy bullet chain comprising a plurality of articulated links, at least one of the links housing the above-disclosed firing shell.

There is further disclosed herein a combination of the above toy bullet chain and the above-disclosed charging mechanism, the charging mechanism comprising a cradle configured to support a link of the chain as the charging piston slides into the charging cylinder.

BRIEF DESCRIPTION OF THE DRAWINGS

Preferred forms of the present invention will now be described by way of example with reference to the accompanying drawings, wherein:

FIGS. 6, 7 and 8 are schematic cross-sectional elevations of a firing shell being loaded into a pressure-charging device;

FIG. 9 is a schematic cross-sectional elevation of a charged firing shell withdrawn from the pressure-charging device;

FIG. 10 is a schematic cross-sectional elevation of a firing shell about to be inserted into a pressure-charging device;

FIG. 11 is a schematic cross-sectional elevation of a pressure-charging device having a lever for providing a mechanical advantage to the user;

FIG. 12 is a schematic cross-sectional elevation showing the firing shell being withdrawn from the pressure-charging device;

FIG. 13 is a schematic cross-sectional elevation of a charged firing shell withdrawn from the pressure-charging device;

DESCRIPTION OF THE PREFERRED EMBODIMENTS

Figure 1:
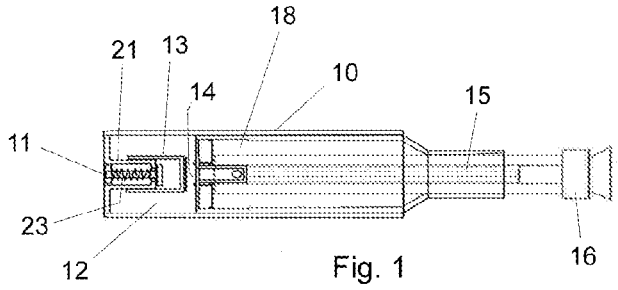
FIG. 1 is a schematic cross-sectional elevation of a firing shell with a soft projectile loaded therein prior to pressure-charging of the pressure chamber.
Figure 2:
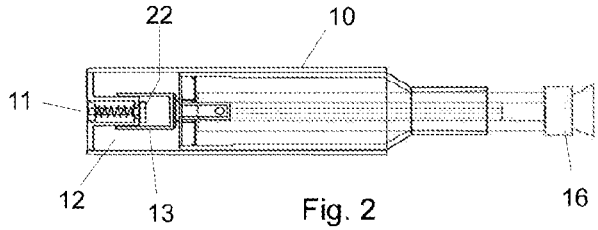
FIG. 2 is a schematic cross-sectional elevation of the firing shell and soft projectile with the pressure chamber charged.
Figure 3:
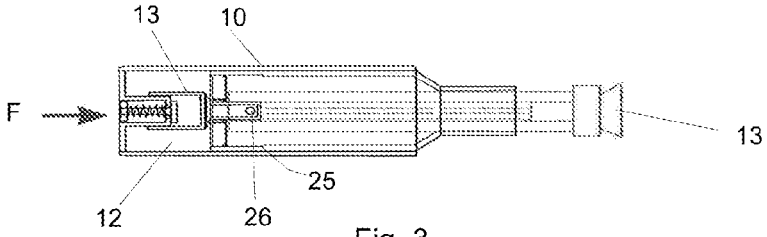
FIG. 3 is a schematic cross-sectional elevation of the charged firing shell and soft projectile just about to be fired.
Figure 4:
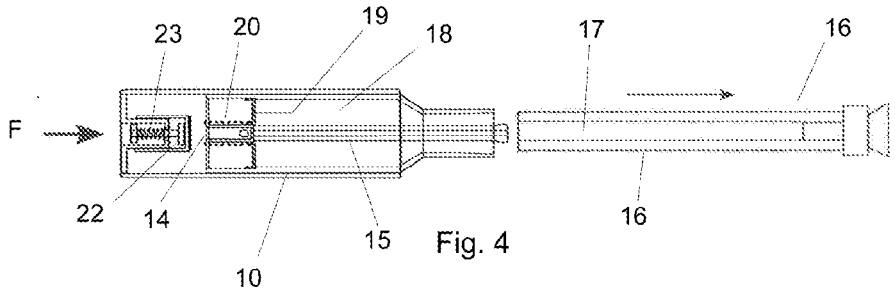
FIG. 4 is a schematic cross-sectional elevation of the firing shell with the soft projectile being fired.

In FIGS. 1 to 3 of the accompanying drawings there is depicted schematically a firing shell 10 which would typically be formed of moulded plastics material. The shell is substantially cylindrical and has at its forward end a firing chamber 18 into which a soft projectile 16 is partially received. At the back of the shell 10, there is provided a pressure chamber 12 which receives a charge of compressed air which upon release by the user causes the soft projectile 16 to be ejected from the firing chamber 18. A release port 14 from the pressure chamber 12 communicates with an elongate firing tube 15 which extends into an elongate cavity 17 provided within the soft projectile.

At the back of the pressure chamber 12, there is an activation member 11 which comprises a pin 22 located within a cylindrical housing 21. The pin 22 is biased to the left by a captured coil spring 23 which surrounds it. At the right end of the cylindrical housing 21, the pin 22 passes through an aperture which is slightly larger than its own diameter. Air can pass around the pin through this aperture. However, spring force applied by spring 23 causes the pinhead (not numbered) at the right-most end of the pin to seal against the aperture. At the left-most end of the pin 22, there is another pinhead (again not numbered) which slides freely within the cylindrical housing 21 and air can pass around it.

Surrounding and sliding upon the outer surface of the cylindrical housing 21 is a piston 13. The flat right hand surface of the piston 13 can bear against the release port 14 to seal the pressure chamber 12. A small O-ring can be provided around the release port to maintain a good seal with the piston 13.

In order to charge the pressure chamber 12 with compressed air, it is necessary to increase air pressure behind (to the left of) the valve 11. When the pressure differential across the valve 11 is sufficient to overcome the force of spring 23, the pin 22 will move to the right and air will flow past it into the pressure chamber 12. When the pressure differential has equalised with the spring force, the valve 11 will seal. Air can leak around the outer surface of the cylinder 21 from within the piston 13 to pressurise the pressure chamber 12. Increased pressure within the chamber 12 forces the piston 13 to seal against the release port 14.

When a firing force F is applied to the left end of the pin 22, the right pinhead will lift from the aperture around the pin at the right end of the cylinder 21 and pressurised air within the piston 13 will escape to atmosphere past the pin toward the left. This rapid reduction of pressure within the piston 13 results in a pressure differential across its flat (right) face causing the piston to move to the left and break the seal at the release port 14. As a result, the charge of compressed air within the pressure chamber 12 escapes rapidly through the release port 14 and into the elongate firing tube 15 to cause the projectile 16 to fire from the shell 10.

Figure 5:
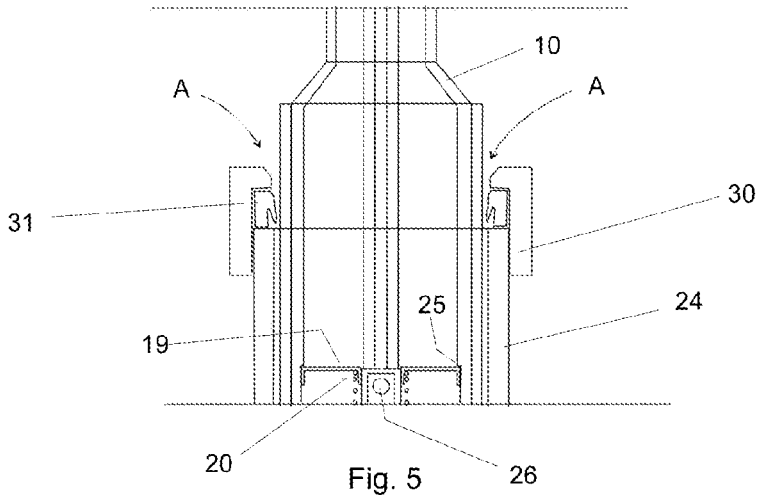
FIG. 5 is a schematic cross-sectional elevation of a portion of a pressure-charging device with the firing shell being withdrawn therefrom.
Figure 14:
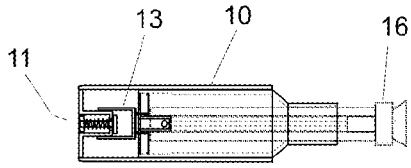
FIGS. 14 and 15 fundamentally repeat FIGS. 3 and 4 for convenience.
Figure 15:
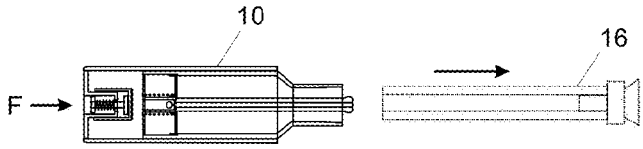

The pressure chamber 12 can be charged by pushing the firing shell 10 into a charging cylinder 24. Such a charging cylinder is shown in FIGS. 5 to 11. As mentioned above, it is only necessary to increase air pressure behind the activation member 11 sufficiently to overcome the force of spring 23 to effect charging of the pressure chamber 12. A typical charging cylinder 24 has a ring cap 30 which locates a seal 31. Seal 31 bears against the outside surface of the firing shell 10 as the firing shell takes up a volume 32 within the charging cylinder 24. Some mechanical advantage might be desirable and to this end, a jig is shown in FIG. 11. This jig includes a base 33 upon which the charging cylinder 24 is mounted. A lever 34 is also mounted upon the base 33. A cup 35 attached to the lever 34 bears down upon the firing shell 10 so as to force it into the charging cylinder to take up the volume Air within the volume 32 compresses and passes the activation member 11 to charge the pressure chamber 12. In order to release the charged firing shell 10 from the charging cylinder the seal 31 may be tapered as depicted in FIG. 5 so that air can enter the volume 32 as indicated by arrows A. Alternatively, a one-way check valve 36 can be provided in the bottom of the charging cylinder 24 so that replenishing air can enter the volume 32 upon withdrawal of the charged firing shell 10.

Figure 19:
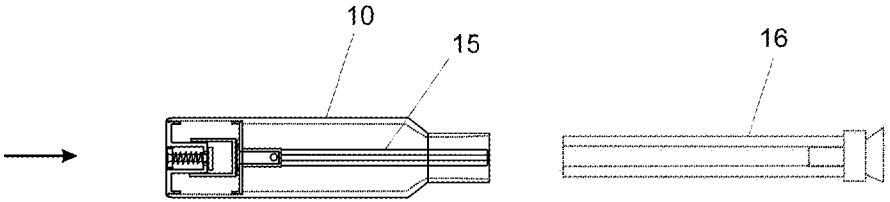
FIGS. 18 and 19 show pre- and post-firing configurations of a firing shell and soft projectile, the firing shell having no protection means against firing of incorrect and potentially dangerous substitute projectiles.
Figure 18:
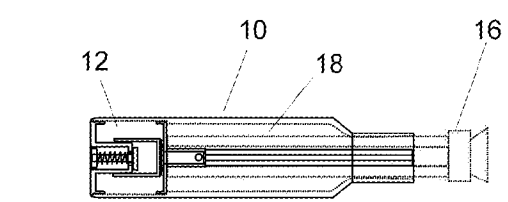

The firing shell 10 is intended to fire safe soft projectiles 16. In order to prevent children from firing other dangerous objects such as pen caps, marbles, pencils and batteries for example various protection means are provided. Examples of these are illustrated in FIGS. 20 to 25. FIGS. 18 and 19 show an embodiment incorporating no protection means and are included alongside these figures for comparative illustration purposes only.

Figure 21:
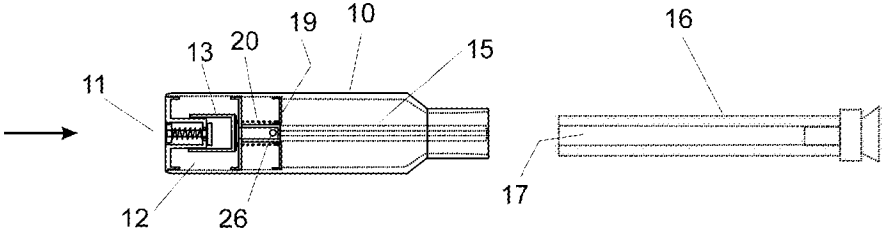
FIGS. 20 and 21 show pre- and post-firing configurations of a firing shell and soft projectile, the firing shell having a sliding protection disc for preventing the firing of incorrect projectiles.
Figure 20:
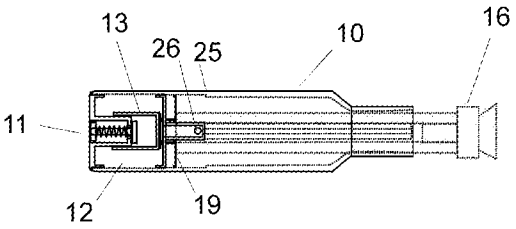

In FIGS. 20 and 21, the protection means comprises a sliding disc 19 located just forward of the release port 14. The sliding disc 19 is biased to the right by a light spring 20 to bear against a step 25 which is formed on the inside cylindrical surface of the firing shell 10. The sliding disc 19 surrounds the elongate tube 15. There is a lateral bleeder hole 26 through the elongate tube 15 via which air within the elongate tube 15 can escape. This bleeder hole 26 is located behind the sliding disc 19 in the rest position. If a pen cap for example were inserted over the elongate tube 15 into the firing shell 10, the sliding disc 19 would remain in position so that a released charge of air from the pressure chamber 12 would escape behind the sliding disc 19 and be captured by it, rather than ejecting the pen cap in dangerous fashion. When the correct soft projectile is inserted over the elongate tube 15, it will push the sliding disc 19 to the left against the light spring 20 and slight frictional engagement between the elongate tube 15 and the internal surface of the elongate cavity 17 will retain the projectile in position until firing. Now when the charge of compressed air is released, it will pass through the bleeder hole of the elongate tube 15 to fire the soft projectile.

Figure 23:
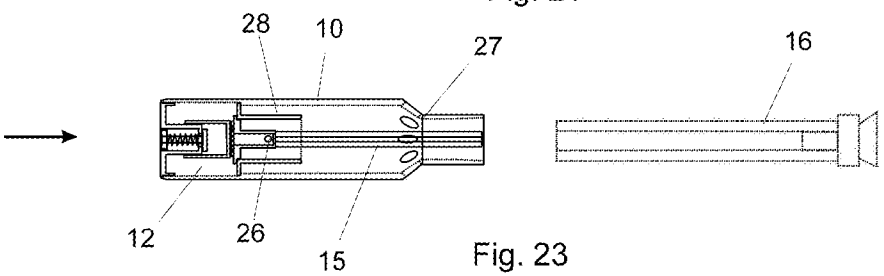
FIGS. 22 and 23 show pre- and post-firing configurations of a firing shell and soft projectile, the firing shell having a base cylinder in the firing chamber and air vents to prevent firing of incorrect projectiles therefrom.
Figure 22:
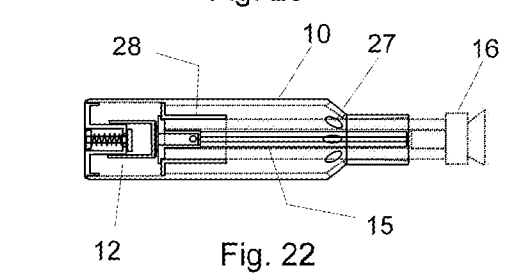

An alternative embodiment is depicted in FIGS. 22 and 23. In this embodiment, a short base cylinder 28 is provided around the bleeder hole 26. Again, if a pen cap or other dangerous object were to be inserted, the base cylinder 28 would prevent it from covering the bleeder hole 26. Even if say a pencil were received closely within the opening of the firing shell 10, vent holes 27 would cause the released charge of air to escape therethrough, rather than firing the pencil. If a proper soft projectile as depicted in the drawings is inserted however, its tail end would be received within the short base cylinder 28 to cover the bleeder hole 26 and air would pass through the elongate cylinder via bleeder hole 26 to fill the space within base cylinder 28 to cause firing of the soft projectile. The vent holes 27 would not then impinge upon firing efficiency.

Figure 25:
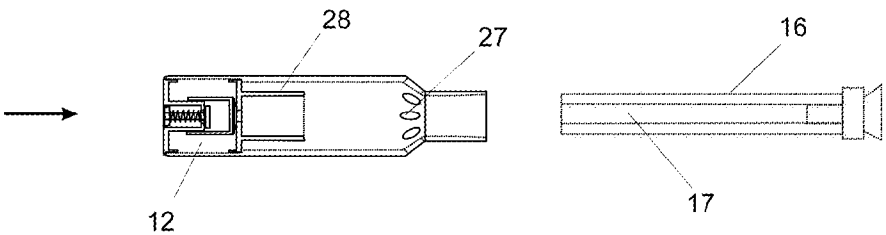
FIGS. 24 and 25 show pre- and post-firing configurations of a similar firing shell to that shown in FIGS. 22 and 23 together with a soft projectile, the firing shell in this embodiment having no elongate firing tube.
Figure 24:
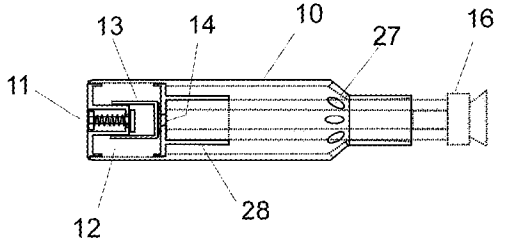

A similar embodiment is depicted in FIGS. 24 and 25. However, in this embodiment, no elongate tube 15 is provided. In this case, the short base cylinder 28 in combination with the vents 27 will be sufficient to prevent firing of the majority of dangerous objects likely to be found and used by children.

Figure 16:
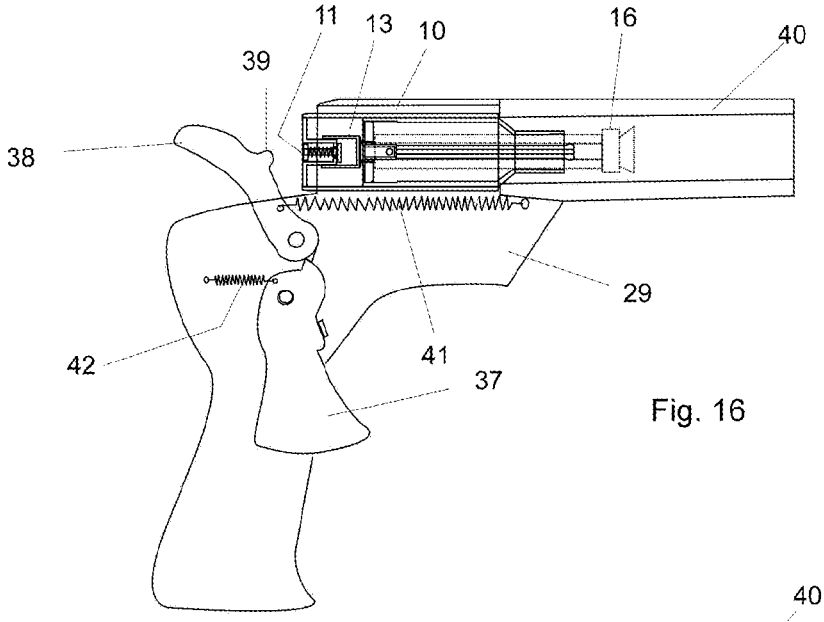
FIG. 16 is a schematic cross-sectional elevation of a toy gun incorporating a loaded firing shell prior to firing.
Figure 17:
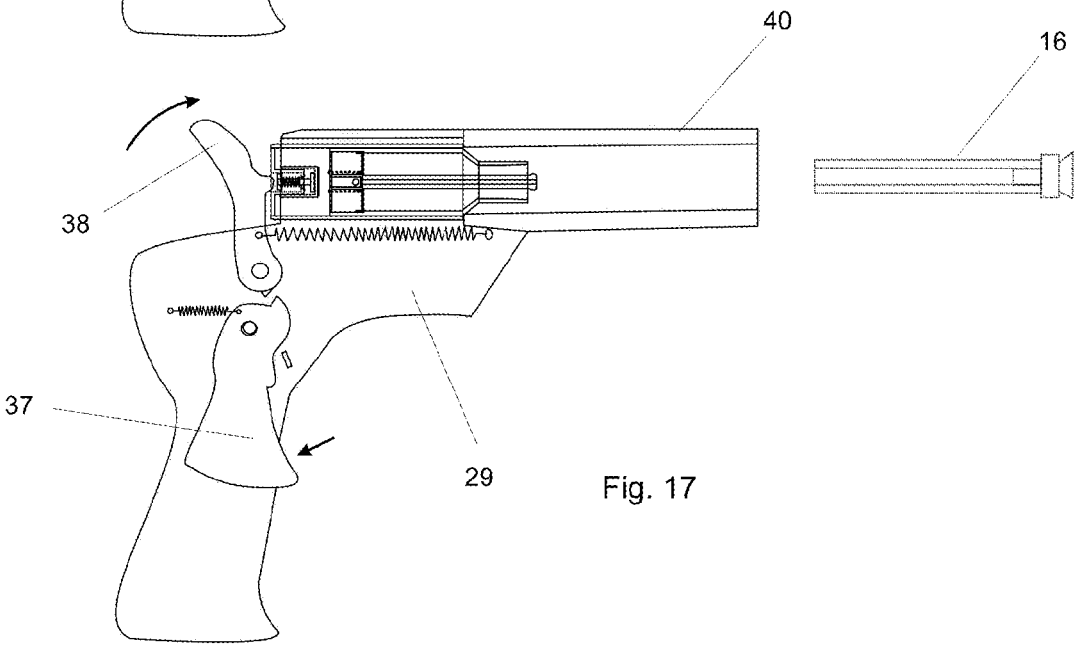
FIG. 17 is a schematic cross-sectional elevation of the toy gun and firing shell with a soft projectile being fired therefrom.

A simple toy gun 29 embodying the invention is depicted in FIGS. 16 and 17. A firing shell 10 could be inserted into the barrel 40, or its features could be formed integrally with the toy gun 29. The trigger 37 pulls against a spring 42 to release a firing lever 38. A strong spring 41 pivots the firing lever 38 to the right so that the firing pin 39 impacts against the activation member 11. This causes firing of the soft projectiles 16 as described above.

Although not depicted, a rapid-fire toy machine gun for example, could include a magazine loaded with a plurality of pre-charged firing shells 10. Alternatively, a bullet chain loaded with pre-charged firing shells 10 could be machine-fed into a firing bay of a toy machine gun.

Figure 26:
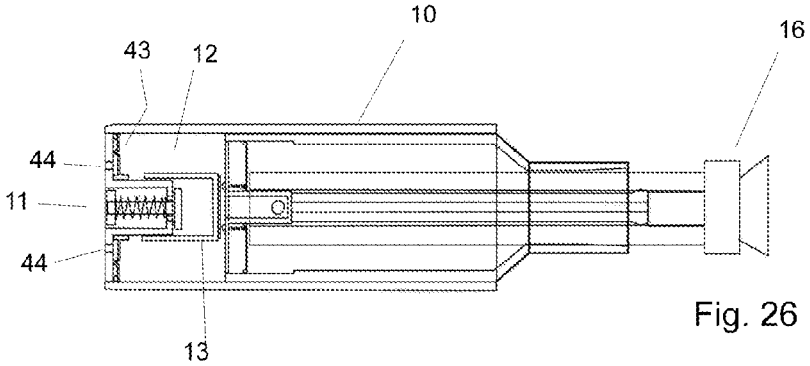
FIGS. 26 and 27 are schematic cross-sectional elevations of a firing shell having an inlet valve formed separately to the activation member before and during priming respectively.
Figure 27:
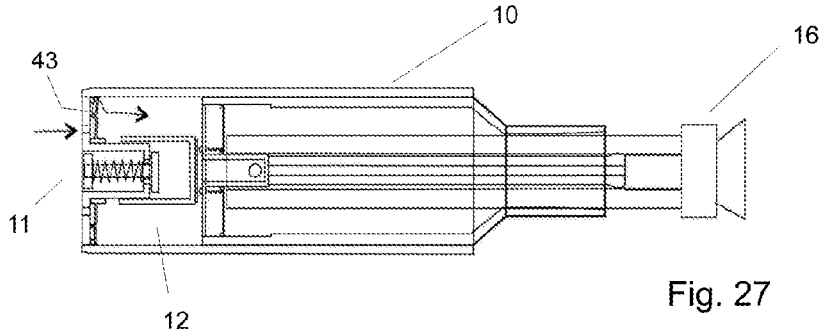

In the above examples, the activation member 11 also functions as an inlet valve via which the pressure chamber 12 is charged. However, separately formed inlet valves are also envisaged. FIGS. 26 and 27 depict an example of this.

A resilient flap 43 surrounding the activation member 11 can cover one or more inlet apertures 44. Upon increased external pressure, air is allowed to flow through the inlet apertures 44 as indicated by the arrow in FIG. 27. After the pressure chamber 12 is primed, the flap 43 will seal the inlet apertures.

Figure 28:
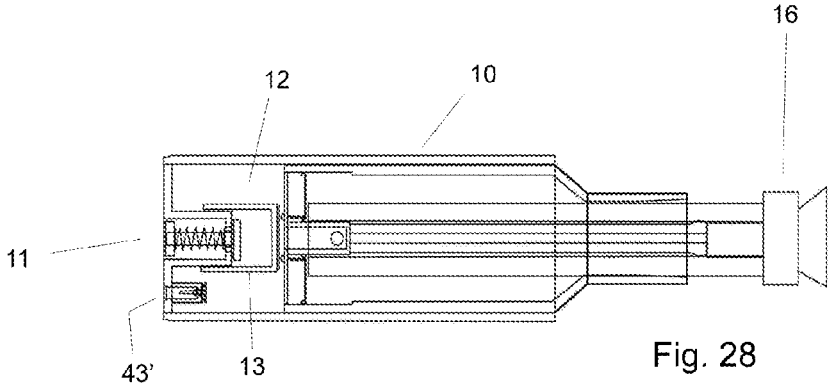
FIGS. 28 and 29 are schematic cross-sectional elevations of the firing shell having a different separately formed inlet valve before and during priming respectively.
Figure 29:
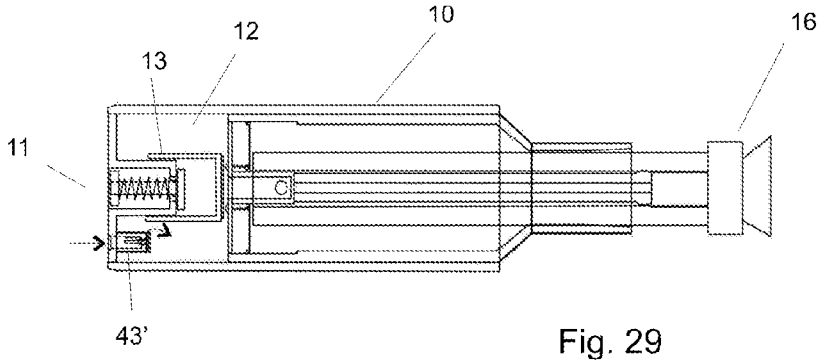
Figure 30:
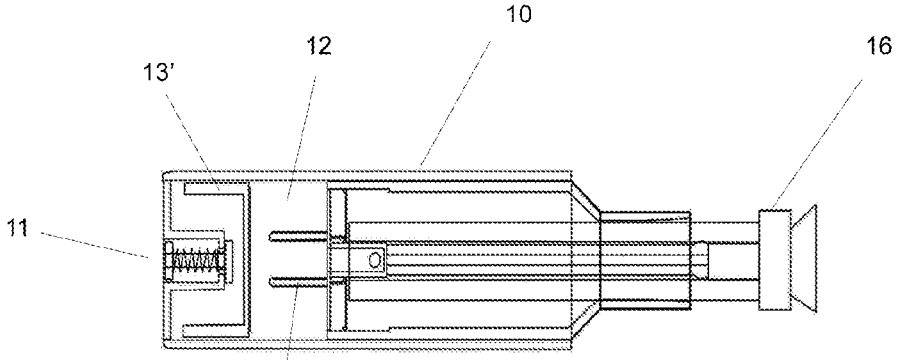
FIGS. 30 to 33 are schematic cross-sectional elevations of a firing shell having an alternative piston configurations at various stages of operation.
Figure 31:
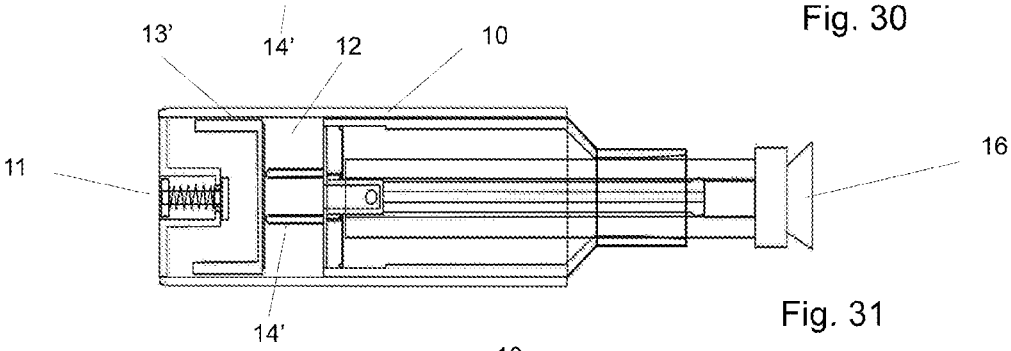
Figure 32:
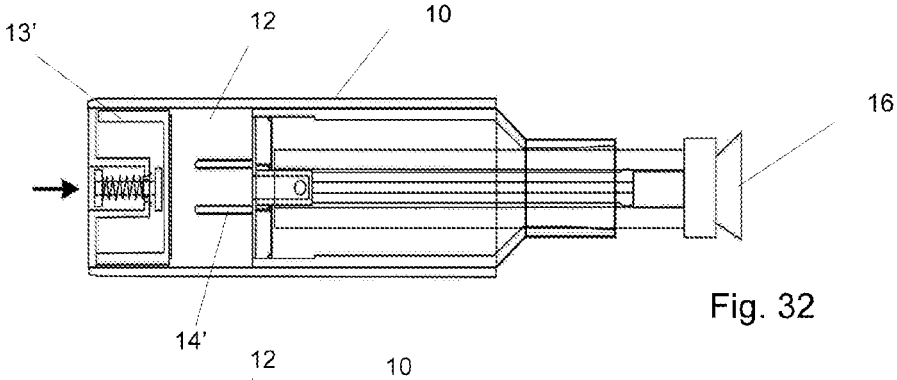
Figure 33:
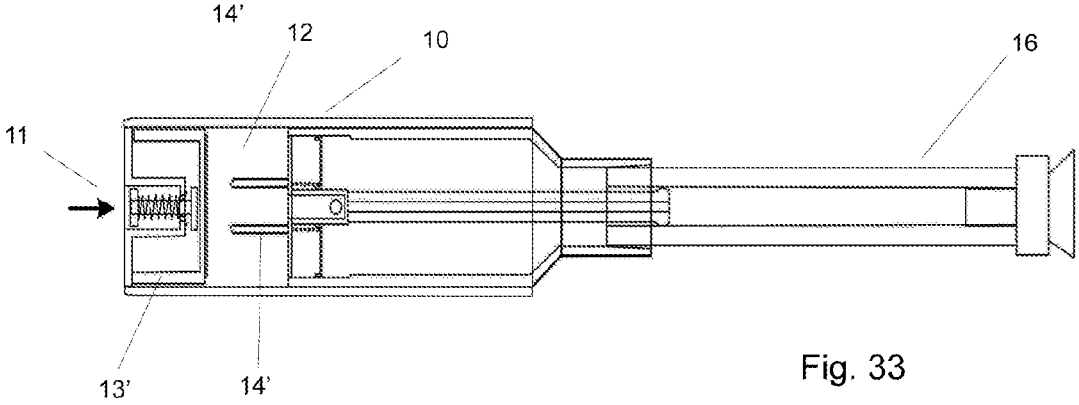

FIGS. 28 and 29 show an alternative arrangement in which a separate inlet valve 43' is provided. This can be in the form of a simple check valve for example. Again, pressurised air can enter the pressure chamber 12 via this check valve. In each of the embodiments of FIGS. 26 to 29, the spring provided in the activation member 11 would be sufficiently strong to maintain a seal at the activation member during priming.

In each of the above embodiments, the piston 13 is mounted upon the activation member 11. An alternative, the piston might be adapted to slide upon the inner surface of the pressure chamber 12. Such an example is shown in FIGS. 30 to 33. Whilst this example may not be as efficient as those previously described, it is nonetheless a viable alternative.

In this embodiment, a broader piston 13' slides within the pressure chamber 12 and is adapted to bear and seal against a projecting release port 14'. This ensures that a volume of air remains to the right of the piston within the pressure chamber 12 at all times. The piston functions in exactly the same manner as does the piston 13 of the previous examples, but there is some loss of efficiency due to the increased surface area of the piston upon which the pressure differential across it takes effect.

As a further alternative, a toy gun could be provided with an inbuilt charging facility similar to charging cylinder 24 and activated upon pump action for example.

Figure 34:
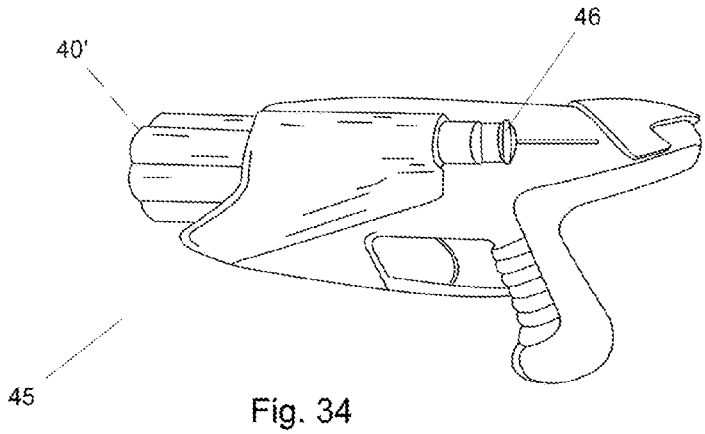
FIG. 34 is a schematic elevation of a toy gun adapted to fire a multitude of soft projectiles from a plurality of firing shells.
Figure 35:
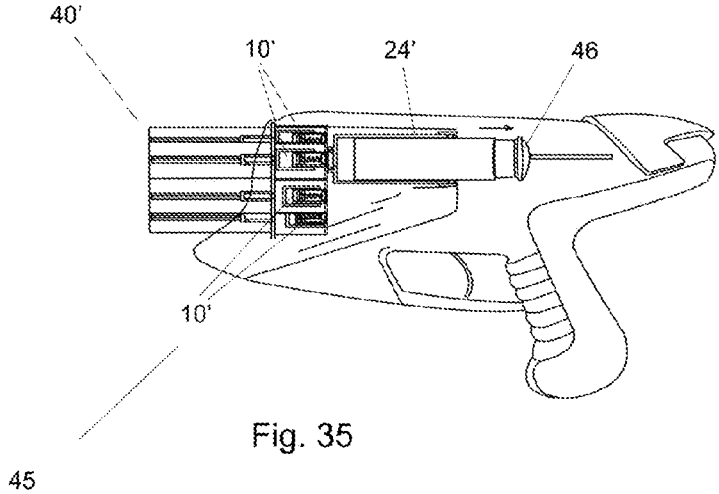
FIGS. 35 and 36 are schematic cross-sectional elevations of a toy gun of FIG. 34 at different stages of operation.
Figure 36:
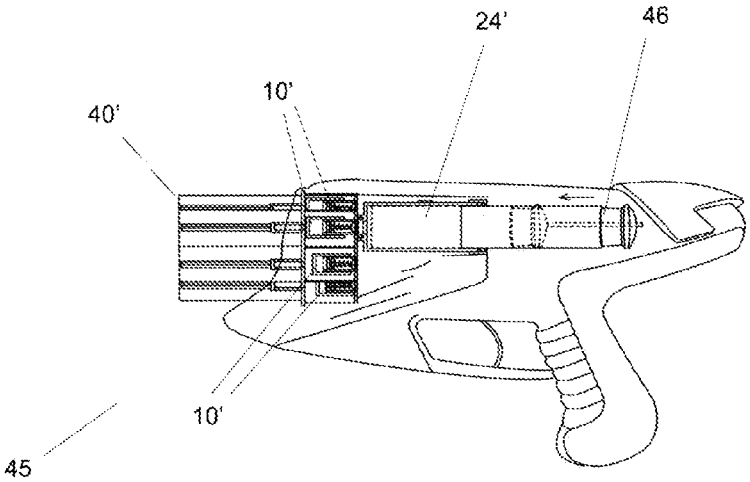

A toy gun 45 for firing a multitude of soft projectiles is depicted in FIGS. 34 to 36. A rotating barrel 40' provides a multitude of firing shells 10' in a circular array. The firing shells rotate about a longitudinal axis at the centre of the barrel 40'. Provided upon the body of a toy gun 45 is an integral charging cylinder 24' having a priming handle 46 extending rearward therefrom. The shells 10' come into alignment with the charging cylinder 24' as the barrel 40' is rotated during play. A player can reciprocate the priming handle 46 to charge each firing shell 10' in turn between firing shots. Retraction of the priming handle 46 will fill the charging cylinder 24' with air. Pushing forward on the priming handle 46 will charge air from the priming cylinder 24' into the pressure chamber of each of the firing shells 10'. The priming handle 46 can be linked to a barrel-advancing mechanism so that the barrel 40' will advance to the next firing shell after each priming action. Alternatively, the barrel 40' could be adapted for manual hand-turning. This would enable all of the firing shells 10' to be primed prior to firing of any one of the shells in play. Moreover, after all of the shells 10' are charged, the player can pull the trigger to strike the activation member and fiery dart. If the trigger is linked to a barrel-advancing system, each activation of the trigger will shoot a dart. This can provide a rapid shooting response—working somewhat like a machine gun.

Figure 37:
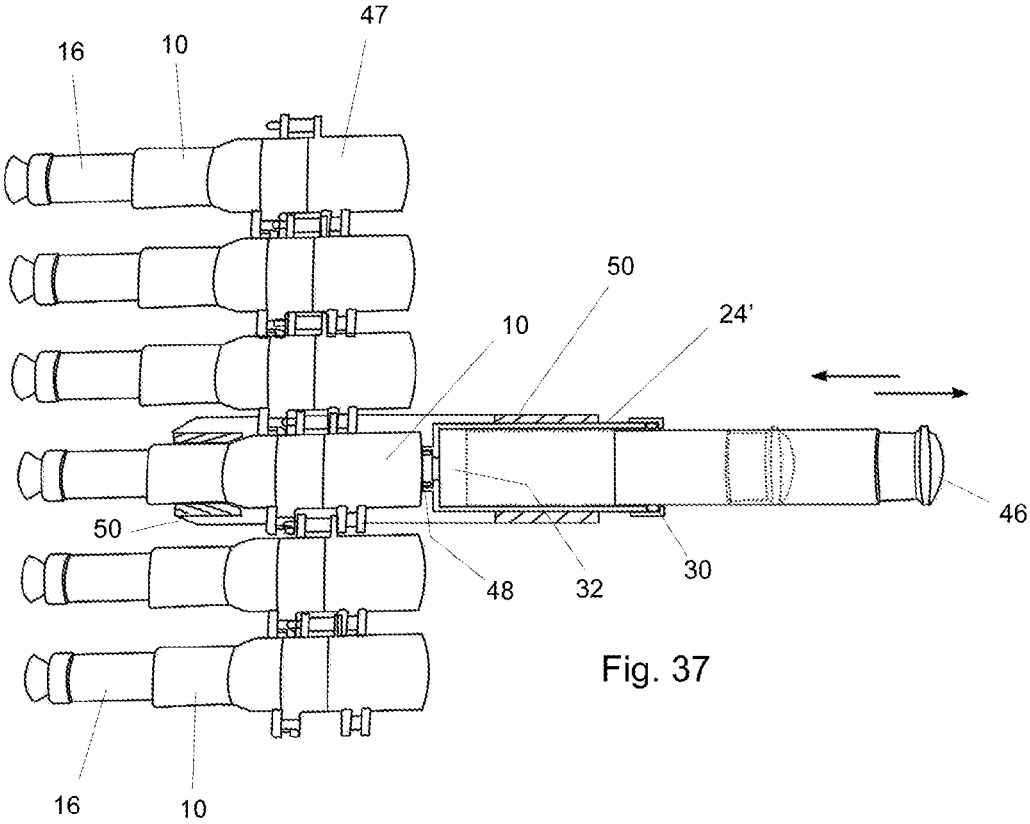
FIG. 37. is a schematic elevation of a toy bullet chain having charging shells loaded within each link of the chain and a stand-alone charging cylinder being used to charge one of the shells.
Figure 38:
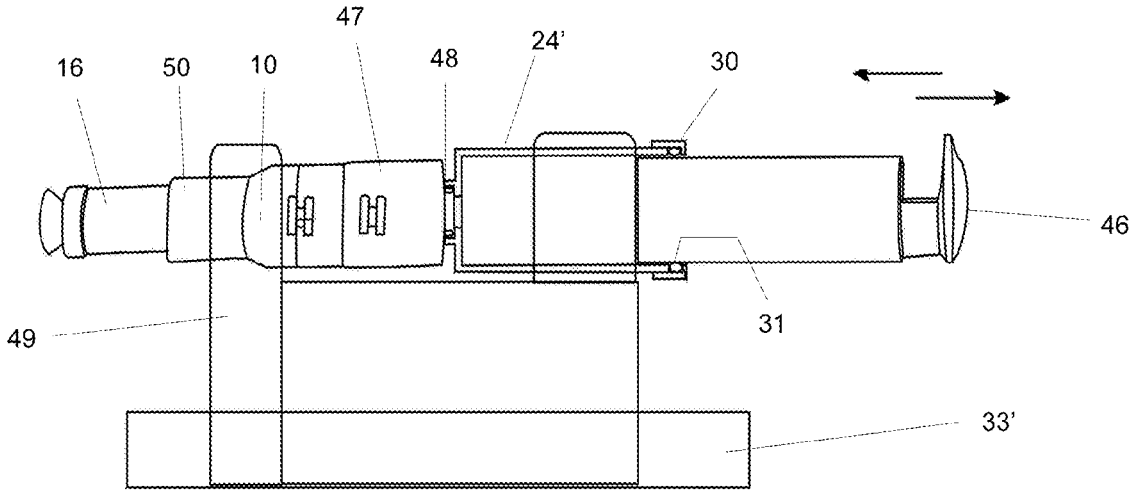
FIG. 38 is a schematic elevation of a stand-alone charging station incorporating the charging cylinder shown in FIG. 37.

Rather than forming a charging mechanism integrally with a toy gun (single shot or multi-projectile), a further style of stand-alone charging mechanism is envisaged. An example is illustrated in FIGS. 37 and 38 and this is designed for use with a bullet chain comprising a plurality of articulated links 47 which may be fed into a toy machine gun.

Each of the links 47 is configured to receive a firing shell 10. Each firing shell 10 may be pre-loaded with projectiles 16.

The charging cylinder 24' is formed into a cradle 50 across which the chain can be draped with one link 47 supported by the cradle at a time. The cradle 50 might be supported by legs 49 to a base 33' as shown in FIG. 38.

The cradle 50 houses a charging cylinder 24'. Rather than inserting the firing shells 10 into the charging cylinder, the shells press against a seal 48 at the left end of the charging cylinder 24'. A charging piston 46 slides into the charging cylinder 24' to reduce its internal volume 32 as indicated by the dotted lines in FIG. 37. The compressed air passes through the inlet valve as described earlier.

The figures depict a cap ring 30 locating a seal 31 which seals against the external surface of the charging piston 46 to maintain pressure. The charging piston 46 may incorporate a check valve (not shown) to ease its extraction from the charging cylinder 24'.

The internal structure of the charging piston 46, charging cylinder 24' and seals 3 and 48 are typically the same as those incorporated into the toy gun of FIGS. 34 to 36 in which some of these details are not shown.

The invention claimed is:

1. A compressed air firing shell for a toy gun, comprising:
- a firing chamber for receiving a projectile;
- a pressure chamber adapted to store a high-pressure charge of air therein;
- a release port from the pressure chamber to the firing chamber;
- an activation member comprising a pin biased by a spring into a sealed position, the pin adapted to move against the spring and away from the sealed position upon application of external air pressure thereto to enable charging of the pressure chamber; and
- a piston within the pressure chamber and sealing the release port and adapted upon triggered activation of the activation member to unseal the release port thereby allowing the charge to pass from the pressure chamber to the firing chamber to effect firing of the projectile therefrom.

2. The firing shell of claim 1, further comprising an inlet valve via which pressurised air can enter the pressure chamber to provide said charge of air.

3. The firing shell of claim 2 wherein said inlet valve is incorporated into the activation member.

4. A charging mechanism when used with the firing shell of claim 2, the charging mechanism comprising a charging cylinder containing a volume of air, the charging cylinder comprising a seal for sealing the volume of air against the exterior of the firing shell, reduction of said volume upon interaction with the firing shell pressurising the volume to thereby open the inlet valve so that air from the volume enters the pressure chamber to charge the pressure chamber.

5. The charging mechanism of claim 4, wherein the volume is adapted to at least partially receive the firing shell to cause said reduction in volume.

6. The charging mechanism of claim 5, wherein the seal is adapted to allow air to flow into the volume upon extraction of the firing shell from the volume.

7. The charging mechanism of claim 5, further comprising a check valve adapted to allow air to flow into the volume upon extraction of the firing shell from the volume.

8. The charging mechanism of claim 5 comprising a base upon which the charging cylinder is mounted, a lever mounted to the base and adapted to bear down upon the firing shell for insertion thereof into the volume.

9. The charging mechanism claim 4, comprising a charging piston adapted to slide into the charging cylinder to cause said volume reduction.

10. The firing shell of claim 1, wherein the activation member comprises a cylindrical housing within which the spring is located, the piston sliding upon the cylindrical housing.

11. The firing shell of claim 1, wherein the pressure chamber comprises a cylindrical inner wall and the piston slides along the inner wall.

12. A toy gun adapted to receive, or having integrally formed therein a multitude of firing shells of claim 1.

13. The toy gun of claim 12, comprising an integral charging cylinder from which pressurised air is charged into each firing shell.

14. The toy gun of claim 13, further comprising an advancing mechanism for aligning each firing shell with said charging cylinder.

15. The toy gun of claim 12, further comprising an advancing mechanism for aligning each firing shell with a charging cylinder.

16. A toy bullet chain comprising a plurality of articulated links, at least one of the links housing the firing shell of claim 1.

17. The toy bullet chain of claim 16 in combination with a charging mechanism comprising:
- a charging cylinder containing a volume of air, the charging cylinder comprising a seal for sealing the volume of air against the exterior of the firing shell, reduction of said volume upon interaction with the firing shell pressurising the volume to thereby open the inlet valve so that air from the volume enters the pressure chamber to charge the pressure chamber;
- a charging piston adapted to slide into the charging cylinder to cause said volume reduction;
- the charging mechanism comprising a cradle configured to support a link of the chain as the charging piston slides into the charging cylinder.

18. A compressed air firing shell for a toy gun, comprising:
- a firing chamber for receiving a projectile;
- a pressure chamber adapted to store a high-pressure charge of air therein;
- a release port from the pressure chamber to the firing chamber;
- an activation member;
- a piston within the pressure chamber and sealing the release port and adapted upon triggered activation of the activation member to unseal the release port thereby allowing the charge to pass from the pressure chamber to the firing chamber to effect firing of the projectile therefrom; and
- a protection means for preventing the firing of items other than a projectile having an elongate cavity from the firing chamber.

19. The firing shell of claim 18, further comprising an elongate firing tube extending into the firing chamber and through which air passes from the release port, the elongate tube adapted to fit within an elongate cavity of the projectile.

20. The firing shell of claim 19, wherein the elongate firing tube comprises a bleeder opening nearby the release port, and wherein protection means comprises a sliding disc surrounding the elongate firing tube and movable between a first use position whereat air exiting the bleeder opening enters the elongate cavity of the projectile causing it to be fired, and a second non-use position whereat air exiting the bleeder opening is trapped behind the sliding disc.

21. The firing shell of claim 20, further comprising a light spring biasing the sliding disc into the second position, the sliding disc adapted to compress the light spring upon interaction with the projectile.

22. The firing shell of claim 18, wherein the protection means comprises vents in the firing chamber adapted to surround the projectile.

23. The firing shell of claim 18, wherein the protection means comprises a base cylinder adjacent to the release port and adapted to surround a portion of the projectile.

24. A toy gun incorporating a compressed air firing shell for a toy gun, comprising:

a firing chamber for receiving a projectile;

a pressure chamber adapted to store a high-pressure charge of air therein;

a release port from the pressure chamber to the firing chamber;

an activation member; and a piston within the pressure chamber and sealing the release port and adapted upon triggered activation of the activation member to unseal the release port thereby allowing the charge to pass from the pressure chamber to the firing chamber to effect firing of the projectile therefrom.

25. The toy gun of claim 24, comprising a trigger-activated firing pin adapted to strike the activation member to effect said triggered firing activation.

26. The toy gun of claim 25, wherein the firing shell is formed integrally with the toy gun.

27. The toy gun of claim 24, adapted to receive the firing shell in removable fashion.

* * * * *